US005513830A

United States Patent [19]

Jaruzel

[11] Patent Number: 5,513,830

[45] Date of Patent: May 7, 1996

[54] FORM PANEL HAVING MARGINAL SECTIONS

[75] Inventor: Kurt Jaruzel, Haslach, Germany

[73] Assignee: Paschal-Werk G. Maier GmbH, Steinach, Germany

[21] Appl. No.: 268,591

[22] Filed: Jun. 30, 1994

[30] Foreign Application Priority Data

Jul. 5, 1993 [DE] Germany ..... 43 22 254.4

[51] Int. Cl.[6] ..... E04G 11/06; E04G 17/00

[52] U.S. Cl. ..... 249/47; 249/196

[58] Field of Search ..... 249/47, 189, 192, 249/193, 196

[56] References Cited

U.S. PATENT DOCUMENTS

| | | | |
|---|---|---|---|
| 3,246,871 | 4/1966 | Bowden | 249/189 |
| 3,446,470 | 5/1969 | Bowden et al. | 249/192 |
| 3,877,674 | 4/1975 | Cerutti | 249/196 |

FOREIGN PATENT DOCUMENTS

| | | | |
|---|---|---|---|
| 2442937 | 6/1980 | France . | |
| 1534952 | 8/1969 | Germany . | |
| 1559060 | 10/1969 | Germany | 249/322 |
| 3122191 | 1/1983 | Germany . | |
| 8502756 | 6/1986 | Germany . | |
| 3545273A | 6/1987 | Germany | 249/47 |
| 3725340A | 2/1988 | Germany | 249/47 |
| 3638537 | 5/1988 | Germany . | |
| 3838488 | 5/1990 | Germany . | |

*Primary Examiner*—Robert J. Warden
*Assistant Examiner*—E. Leigh Dawson
*Attorney, Agent, or Firm*—Panitch Schwarze Jacobs & Nadel

[57] ABSTRACT

A form panel 1 has marginal sections 2, arranged at parallel edges or running around all the edges, which have a hollow cross-section and have in each case located at right angles to a lining skin 3 an abutment web 4 composing the outermost edge of the form panel 1. The abutment web 4 can be laid against a corresponding abutment web 4 or against a marginal strip 5, for instance a flat marginal strip 5 of a neighboring form panel. The further webs of the hollow marginal section 2 are in the form of an approximately U-shaped section 6 with two U-limbs 7, 8 and a crosspiece 29. The edges of the U-limbs 7, 8 are overlapped by the abutment web 4, and at least one U-limb, suitably the U-limb 7 remoter from the lining skin 3, is firmly connected, e.g., welded, to the abutment web 4. The abutment web 4 has a fastening flange 9 engaging, particularly lapping over the side of the lining skin 3 facing the concrete, but at the same time suitably sunk into the lining skin 3. A groove 10 for receiving and embracing the edge of the lining skin 3 is formed by the flange 9 together with the fastening web of the marginal section 2 and the intermediate portion of the abutment web 4, said fastening web formed by the U-limb 8 which is closest to the lining skin 3 and during use contacts the side of the lining skin facing away from the concrete. The lining skin is clamped in the groove with the aid of screws/bolts traversing the lining skin.

16 Claims, 3 Drawing Sheets

FORM PANEL HAVING MARGINAL SECTIONS

FIELD OF THE INVENTION

The invention relates to a form panel, particularly for pouring concrete structures, having marginal sections arranged along at least two parallel edges or running around all the edges of the panel. The marginal sections have a closed, hollow cross-section with an abutment web located at right angles to a lining skin of the panel. The abutment web extends along the outermost edge of the form panel and serves to be laid tightly against a corresponding abutment web or marginal strip of a neighboring form panel.

BACKGROUND OF THE INVENTION

Such form panels are known in a wide spectrum of forms. Marginal sections having a hollow cross-section produce good stiffness and can be fastened together with the aid of clamps. It is important that these marginal sections, which must sustain high forces, also be connectable with corresponding security and firmness to the lining skin itself, in order that the respective flux of force is also attained there.

Such formwork is known, for example, from German Patent DE 38 38 488 C2. The marginal sections, provided with a closed, approximately rectangular hollow cross section, have in the holding web a channel-like depression for application of a clamp, as is known by way of example from German Utility Model No. 88 14 208. Such a clamp is made to conform to double the size of a hollow marginal section and can bring about only a frictional connection.

In many cases, however, it may be suitable for form panels of the formwork to have not only marginal sections with a hollow cross section, but also marginal strips consisting of flat material, this being advantageous particularly if and when, for instance, form panels variable in their curvature are to be combined with flat form panels. The clamps permitting a specific closing travel are unsuited for such combinations of a hollow marginal section with a marginal strip consisting of flat material.

Hitherto, such form panels with only flat marginal strips have been connected, as a rule, by connecting bolts conforming generally to German Patent No. 21 37 505. However the clearance between projections jutting out at right angles to the bolt surface and counter-stops is too small for these connecting bolts to be able to traverse marginal sections having a hollow cross section.

A proposal has become known from German Patent DE 38 38 509 C1 that two marginal sections having a hollow cross section be traversed in a direction parallel to the lining skin and thereby be connected by a relatively long and elaborate bolt. However, this requires that the hollow sections have through holes which either weaken them or have to be furnished with sleeves inside the marginal sections as a guide for the respective bolt, increasing the manufacturing expenditure accordingly.

SUMMARY OF THE INVENTION

The object underlying the present invention is therefore to configure a form panel with marginal sections in such a way as to enable secure and good fixation to the lining skin of the panel.

This object is accomplished in a form panel with a marginal section having an abutment web, and further webs of the marginal section compose an approximately U-shaped section with two U-limbs and a crosspiece. The end edges of the U-limbs are overlapped by the abutment web and at least one U-limb is firmly connected to the abutment web. The abutment web has a flange engaging the side of the lining skin facing the concrete, and a groove for receiving an edge of the lining skin is formed by the flange together with the fastening web of the marginal section and an intermediate portion of the abutment web. The fastening web is composed of one of the U-limbs which is closest to the lining skin and in the position of use bears against the side of the lining skin facing away from the concrete.

In contrast to the otherwise customary arrangement of the lining skin in an angular space between abutment web and fastening web, provision is hence made for a groove capable of embracing the edge of the lining skin on both sides, enabling the lining skin to be fastened correspondingly securely and at the same time also well protecting this edge on the side facing the concrete. Since the lining skin has its edge arranged in a groove belonging to the marginal section which has a hollow cross-section, forces of commensurate magnitude can be transferred between lining skin and marginal section.

It is particularly suitable if the fastening web is movable relative to the back of the abutment web and is elastically deformable or deflectable for clamping the lining skin between itself and the flange of the abutment web. By this means, the lining skin can thus be clamped in the groove provided for its reception in the marginal section, producing not only an improved fixation of the lining skin, but at the same time also a stiffening of the marginal section by means of the lining skin.

The fastening web may have tapped holes, and the fastening flange, which is sunk particularly into the lining skin surface facing the concrete may have holes at registering height for inserting fastening screws/bolts traversing the lining skin. Hence, the fastening web can be drawn and pressed against the back of the lining skin with the aid of the fastening screws/bolts, resulting in clamping forces of commensurate magnitude within the groove. It is beneficial in this context that the fastening web not be fastened to, but be movable relative to the abutment web, so that respective clamping movements can be carried out unhindered.

Nevertheless, such a screwed/bolted fixation between the lining skin and the marginal section produces such a close and stable connection that the entire edge area is stiffened better by this means. This is the case because the edge of the lining skin is included in the stiffening, and the fastening web, which is actually movable, is also connected to the flange of the marginal section by way of the fastening screws/bolts and the intermediate lining skin. Tapped holes are also to be understood to include such holes as have welded to their opposite ends a part having an internal thread. Hence, by way of example, a nut might be welded onto the movable fastening web on the side thereof averted from the lining skin, and then the fastening bolt can be screwed from the flange into the nut.

This is possible especially if and when the U-limb remote from the lining skin is connected, particularly welded, to the abutment web, particularly at the free edge thereof. The threaded couplings could then be fitted to the fastening webs before such a connection or welding. Moreover, in this way it is possible for the abutment web to be formed with a different cross-sectional thickness than the other webs of the marginal section. Hence, parts presenting an internal thread, e.g., nuts, registering with through holes may be arranged on the side averted from the lining skin, after which the U-shaped part can be fastened to the abutment web.

The fastening screws/bolts may have heads sunk into the fastening flange and are capable of being twisted relative to the thread of the tapped holes in the fastening web and tightened for clamping the lining skin. Compared with such fixations in which screws are screwed from the outside into the lining skin, the advantage hence ensues that the thread transferring the holding power is not self-cuttingly applied in the lining skin, but is provided in a correspondingly stable mating part.

The fastening web, which forms part of the marginal section and presents the tapped holes, may butt against the outside of the abutment web without being fastened to it. The fastening web might also be spaced at this location. However, it is suitable for the fastening web to butt against the abutment web in order to practically close the hollow cross-section of the marginal section despite the movability of the fastening web and to take advantage of the distance between the U-crosspiece and the abutment web through a fastening web of maximum length in cross-section.

One development of the present invention, which is possible particularly if and when the hollow marginal section comprising abutment web and U-shaped section is joined and welded together, may provide the abutment web with perforations, keyhole-like or oblong perforations, for inserting connecting bolts having at their end at least one projection which juts out radially from the cross-section of the bolt. In the locking position or twisted position, the projection engages behind the edge of the perforation. The spacing and size of the perforations in the abutment web corresponding with the dimension of similar perforations in flat strips of material edging neighboring form panels. The clearance between the radially jutting out projection and an axially spaced counter-stop, e.g., a disc spring or the like, of the connecting bolt corresponds to the overall thickness of a flat marginal strip material of a neighboring panel and an abutment web of the hollow marginal section or the overall thickness of two flat marginal strips or two abutment webs.

Since the hollow marginal section is composed of an abutment web and a U-section, the abutment web can first be provided with relative perforations and then also allow such form panels to be connected as do not have an identical edge, but instead of a hollow marginal section have only a flat marginal strip with corresponding perforations. The form panel therefore becomes universally usable and can be easily combined with different form panels. This may be advantageous particularly if the form panels in question are variable in their curvature and if, through the curvature and especially one of small radius, little space is available in the area of the mutual edge connection.

It is then suitable if the perforations in the abutment web are arranged within the marginal section so close to the lining skin and fastening web that in the anchoring or locking position the projection(s) jutting out radially from the connecting bolt reach interiorly up to the fastening web or engage with a recess provided in the fastening web near the perforations in the abutment web. In an advantageous way the connecting bolts can hence be arranged as near as possible to the lining skin and to the groove provided in the marginal section for the purpose of gripping the lining skin, so as to be able to optimally transfer the connecting forces.

Even if the groove provided according to the invention in the marginal section for the purpose of gripping the lining skin has an inside width of a thickness such that a thicker lining skin can be gripped than that of the form panel having a flat marginal strip, the above-described measures nevertheless allow the arrangement of perforations to be provided with corresponding distance from the lining skin surface facing the concrete. Therefore, such different form panels can be connected in such a way that, even if they have lining skins of different thickness, their surfaces facing the concrete are in alignment.

The recesses for projections of connecting bolts and the tapped holes—with which the lining skin is fastened in the groove of the marginal section—may be staggered in the longitudinal direction of the marginal section. Therefore, in the arrangement of connection holes for fastening the lining skin, no regard need to be paid to such recesses which, for their part, allow connecting bolts to be fitted as close as possible to the lining skin.

Altogether a form panel results having, arranged along at least two parallel edges or along all four edges, marginal sections which present a hollow cross-section and permit a frame-like border of the lining skin and hence, a protected arrangement of this edge of the lining skin, accompanied by optimal fixation and correspondingly good introduction of forces, wherein marginal section and form panel can at the same time stiffen and stabilize each other in the edge area. It is beneficial particularly that the lining skin is secured in position not only by way of the shearing forces of the fastening screws/bolts, but through a clamping in the groove, so that the shearing forces of the fastening screws/bolts are additionally available in reserve.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there are shown in the drawings embodiments which are presently preferred. It should be understood, however, that the invention is not limited to the precise arrangements and instrumentalities shown. In the drawings, partly in schematic form.

DETAILED DESCRIPTION OF PREFERRED EMBODIMENTS

Figure 1:
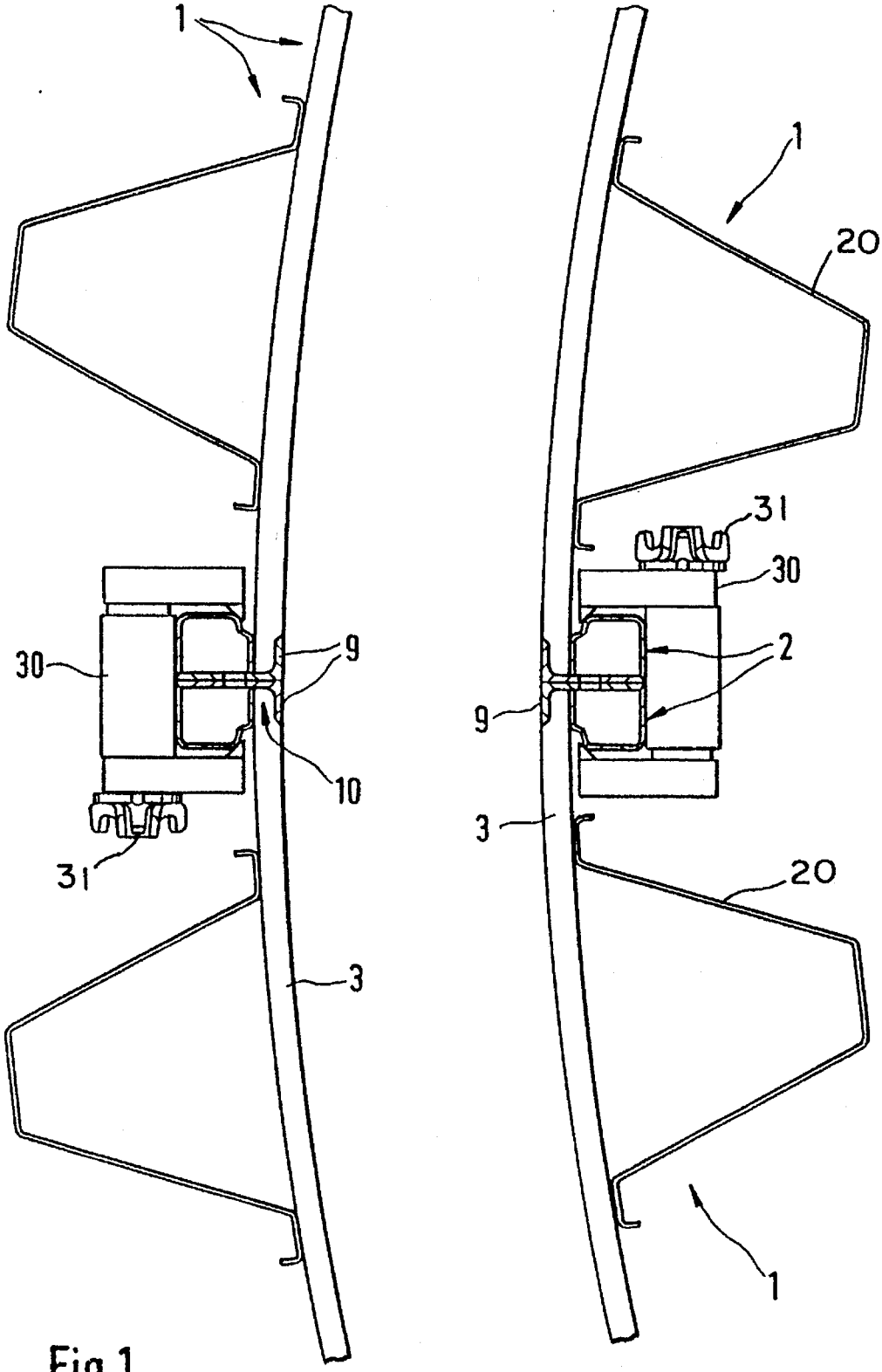
FIG. 1 shows the joints of two pairs of form panels according to the invention, shown in a top view and partly in cross-section with respect to the marginal sections, with the curved form panels facing each other for pouring concrete in the space therebetween.

Form panels 1 are shown only partially with one edge in the various embodiments. In each case, the form panels have marginal sections arranged on at least two parallel edges or running around all the edges, where the marginal sections present a closed cross-section. These marginal sections are designated generally by the reference number 2 and will be referred to in short as "marginal sections 2" in the following.

The form panels are suited for forming curved surfaces and may even be changed in their curvature. The lining skin 3 of the form panel has trapezoidal stiffening girders 20 between the edges. The lining skin 3 may suitably comprise wood, preferably a wood laminate, or other suitable materials, while the marginal sections 2 may be made of metal, preferably iron, or other suitable materials.

Figure 2:
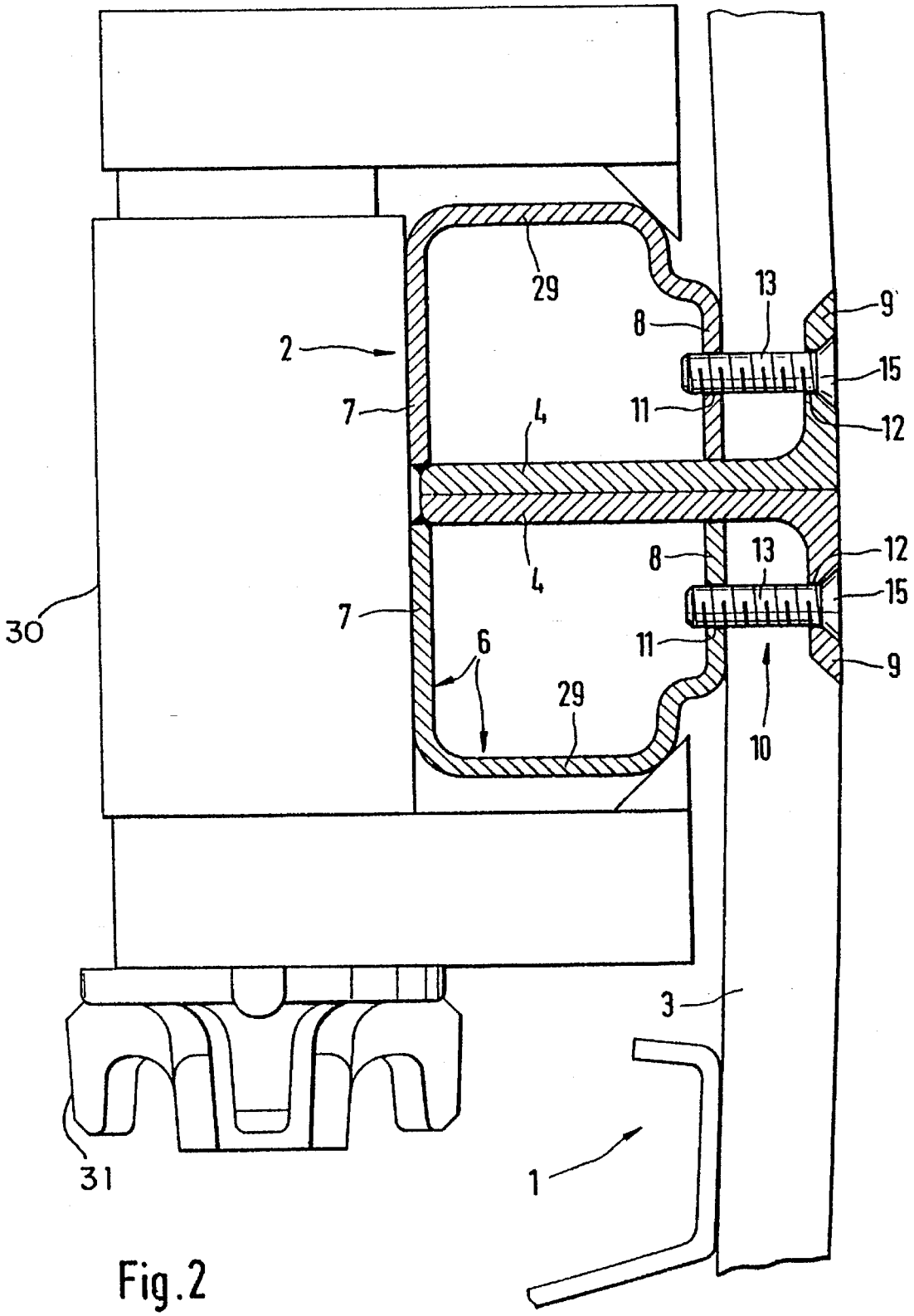
FIG. 2 shows, on an enlarged scale, a cross-section through the marginal sections of two contiguous form panels according to the invention, with the lining skin fastened to the marginal sections.
Figure 3:
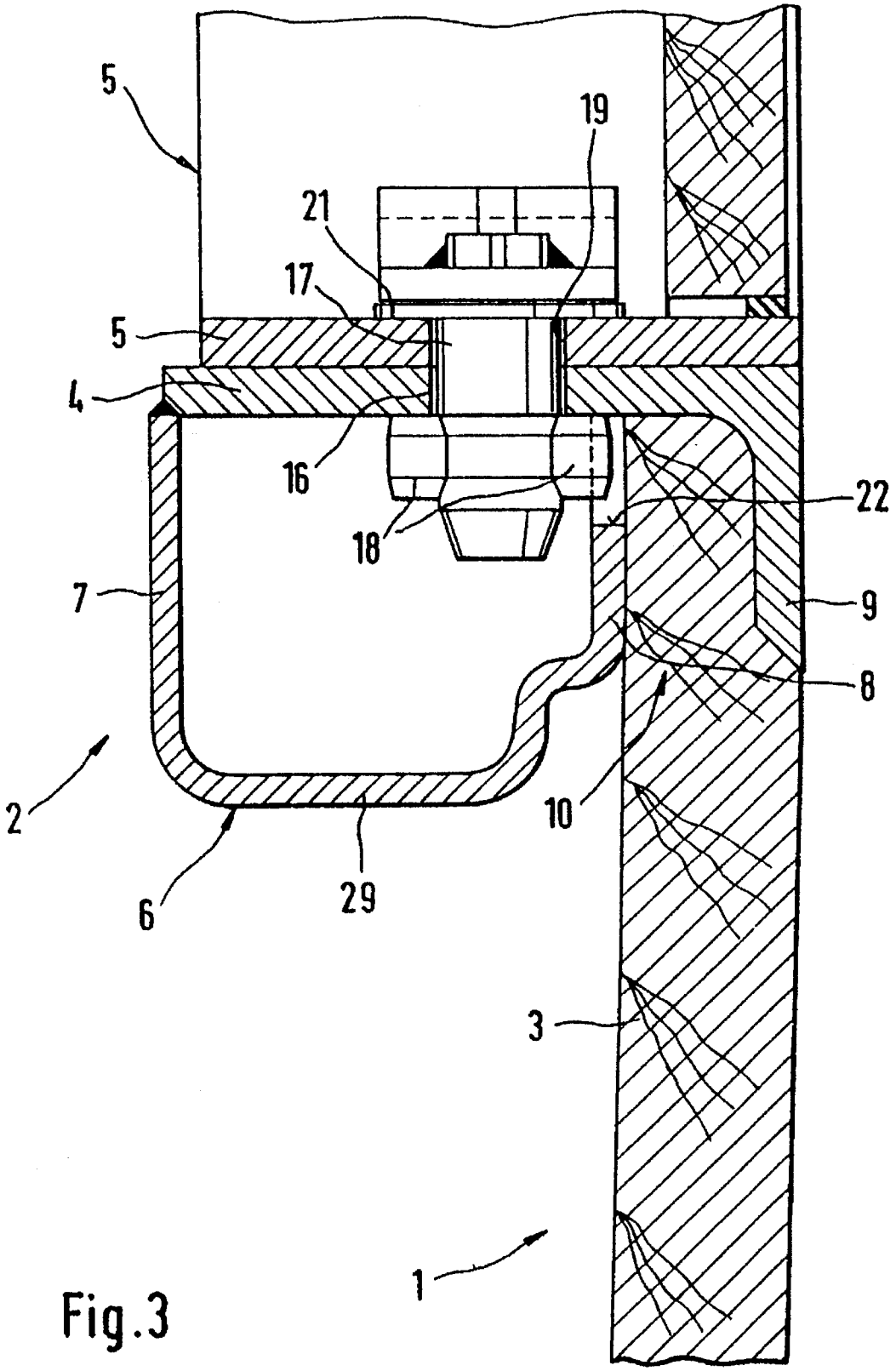
FIG. 3 shows a modified embodiment of the invention in which, connected to a form panel having a marginal section presenting a hollow cross-section, there is a further form panel having only two flat marginal strips, wherein for joining the two form panels connecting bolts are provided having projections arranged transversely of the bolts and having counter-stops.

In particular, FIGS. 2 and 3 show that the marginal sections 2 in each case have an abutment web 4 running at the outermost edge of the form panel 1 and located at right angles to the lining skin 3 for being laid tightly against a corresponding abutment web 4 or marginal strip 5 of a neighboring form panel. According to FIGS. 1 and 2, in the embodiment shown, two abutment webs 4 of adjacent form panels 1 rest against each other, while according to FIG. 3, a flat marginal strip 5 of a form panel is fastened to an abutment web 4 of a form panel 1.

It becomes clear from the cross-sections shown of the marginal sections 2 that the further webs of the marginal section 2, which are present in addition to the abutment web 4, comprise a U-shaped section 6 with two U-limbs 7 and 8 and a U-crosspiece 29, wherein the edges of the U-limbs 7 and 8 lie in a common plane and are overlapped by the abutment web 4, it being apparent in FIGS. 2 and 3 that the U-limb further away or remote from the lining skin 3 is connected, namely welded, to the abutment web 4 at the free edge thereof.

The abutment web 4 extends in the direction of the lining skin 3 past the U-limb 8 and has a flange 9 engaging the side of the lining skin 3 facing the concrete. According to FIGS. 2 and 3, a groove 10 for receiving the edge of the lining skin 3 is formed by this flange 9 together with the fastening web of the marginal section 2 and an intermediate portion of the abutment web 4 passing the end edge of the lining skin 3, said fastening web comprising the U-limb 8 and being closest to the lining skin 3 and in the position of use bearing against the side of the lining skin facing away from the concrete. The edge of the lining skin 3, which is often made of wood and is therefore delicate, can hence be firmly surrounded and well protected by this groove 10 of the marginal section 2. At the same time, however, the forces arising between the lining skin 3 and the marginal section 2 can be optimally transferred.

The fastening web formed by the U-limb 8 is movable relative to the back of the abutment web 4 and is elastically deformable or deflectable for clamping the lining skin 3 between itself and the flange 9. This could be utilized for the purpose of the groove 10 being slightly narrower than the thickness the lining skin 3 is envisaged to have in this edge area, so that pushing the lining skin into the groove 10 simultaneously brings about a clamping effect.

According to FIG. 2, however, it is contemplated in an even more suitable manner, and in one advantageous for improved transfer of force, that the fastening web 8 have tapped holes 11 and that the fastening flange 9, particularly sunk into the lining skin 3 surface facing the concrete, have holes 12 at registering height for inserting fastening screws/bolts 13 traversing the lining skin 3. Hence, the edge of the lining skin 3 can be pushed into the groove 10, after which the fastening screws/bolts 13 are inserted from the flange side and can be screwed home in their tapped holes 11. By tightening the fastening screw/bolts 13, the fastening web 8 can be drawn and pressed against the lining skin, so that the lining skin 3 is thereby clamped in the groove 10 and is additionally form-lockingly located in position by the screws/bolts traversing it. Forces of commensurately great magnitude can thus be sustained, whereby lining skin 3 and marginal section 2 reinforce and stiffen each other.

Mention is made at this juncture that, arranged at that side of the fastening web 8 which is averted from the lining skin 3 and at locations corresponding to the holes therethrough, parts might be provided with an internal thread, e.g., nuts, so as to be able to screw in the fastening bolts 13. In the embodiment shown, however, the mating thread for the fastening screws 13 is directly in the U-limb 8 composing the fastening web.

The fastening screws/bolts 13 have heads 15 sunk into the fastening flange 9, so that the flat and flush surface of the fastening flange 9, running approximately level with the surface of the lining skin 3 facing the concrete, is not interrupted. The fastening screws/bolts 13 can be twisted at their heads 15 and hence, tightened relative to the thread of the tapped holes 11 in the fastening web 8. The clamping force is thereby applied at the edge of the lining skin. Since, however, the fastening screws/bolts 13 simultaneously traverse the lining skin 3, particularly good fixation ensues which is based not on friction alone or on a screwed connection alone, but in a way as a double action.

The fastening web 8, which forms part of the marginal section 2 and contains the tapped holes 11, butts against the outside of the abutment web 4 without being fastened to it, so that the fastening web is able to carry out the above clamping movement as required, but nevertheless closes the hollow cross-section of the marginal section 2.

FIG. 3 indicates that the abutment web 4 may have perforations 16, for example keyhole-like or oblong perforations, for inserting connecting bolts 17. FIG. 3 illustrates one such connecting bolt 17, showing that the connecting bolt 17 has at its end at least one, in the embodiment shown two, projections 18 which jut out radially from the cross-section, and in the locking position or twisted position engage behind the edge of the perforation 16. The spacing and size of the perforation 16 in the abutment web 4 accords with the corresponding dimensions of such perforations 19 in a marginal strip 5 of flat material which borders a neighboring form panel to be seen in FIG. 3. It is therefore possible for form panels having edges of different configurations to be coupled without any difficulty by such a connecting bolt 17, although one form panel 1 is provided with a marginal section 2 having a hollow cross-section.

The clearance between the radially jutting out projections 18 and an axially spaced counter-stop 21 of the connecting bolt 17, e.g., a disc spring or the like, corresponds to the overall thickness of the marginal strip 5 and abutment web 4.

The mentioned perforations 16 in the abutment web 4 are arranged within the marginal section 2 so close to the lining skin 3 and fastening web 8 that in the anchoring position the projection(s) 18 jutting out radially from the connecting bolt 17 reach interiorly up to the fastening web 8 or, in the embodiment shown, even engage with a recess 22 provided in the fastening web 8 near the perforation 16 in the abutment web 4. Therefore, the connecting bolt 17 can hence be provided as near as possible to the lining skin and the concrete, and allowance can be made for the fact that the lining skin 3 of the form panel with the hollow marginal section 2 may be thicker—also on account of the greater stability—than the lining skin of the neighboring form panel having only a flat marginal strip 5.

The recesses 22 for projections 18 of connecting bolts 17 and the tapped holes 11 are staggered in the longitudinal direction of the marginal section 2, so that the recesses 22 do not cause any weakening to the area of the tapped holes 11.

According to FIG. 3, the hollow marginal section 2 of a form panel 1 can be connected to a flat marginal strip 5 of a neighboring form panel with the aid of the connecting bolt 17. According to FIGS. 1 and 2, however, two hollow marginal sections 2 can also be gripped together with the aid of a clamp 30 embracing them both, the clamp being tightenable by means of a wing nut 31 which turns a longitudinal bolt (not shown). Two form panels 1 can thereby be connected.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A form panel for pouring a concrete structure, said form panel (1) comprising:

a lining skin (3) having two parallel sides with parallel horizontal and vertical edges, wherein a first side faces a concrete structure and a second side faces away from the concrete structure; and a marginal section (2) arranged on at least two parallel vertical edges of the lining skin, and which connects the lining skin of the form panel to a neighboring panel, said marginal section having a hollow cross-section and comprising an abutment web (4) positioned at a right angle to the said parallel sides of the lining skin (3) and extending along the vertical edges on an end of the lining skin, said abutment web laying against a corresponding abutment web of a neighboring form panel, the abutment web further including a flange (9) engaging the side of the lining skin facing the concrete structure;

a U-shaped section (6) composed of first and second limbs (7,8) and a crosspiece (29), each limb having a free end, wherein the abutment web extends over the two free ends of the limbs with the free end of the first limb (7) being connected to the abutment web and the free end of the second limb (8) being unconnected to the abutment web, said second limb being elastically deformable; and a U-shaped groove for receiving a vertical edge of the lining skin, the groove defined by the flange of the abutment web, the second limb, and a section of the abutment web adjacent and perpendicular to the flange.

2. A form panel according to claim 1, wherein the marginal sections (2) are located along the vertical and horizontal edges of the lining skin (3).

3. A form panel according to claim 1, wherein the second limb (8) has tapped holes (11) and the flange (9) is sunk into the side of the lining skin which faces the concrete structure and has holes (12) registering with the tapped holes (11) for inserting fastening bolts (13) through the lining skin (3).

4. A form panel according to claim 3, further comprising parts with an internal thread registering with the tapped holes and arranged on a side of the second limb (8) remote from the lining skin (3).

5. A form panel according to claim 4, wherein said parts comprise nuts welded to said second limb.

6. A form panel according to claim 3, further including fastening bolts (13) and wherein the fastening bolts (13) have heads (15) sunk into the flange (9) and are twistable relative to a thread of the tapped holes (11) and tightenable for clamping the lining skin (3).

7. A form panel according to claim 3, wherein the second limb (8) butts against the abutment web (4) without being fastened thereto.

8. A form panel according to claim 1, wherein the first limb (7) is welded to the abutment web (4).

9. A form panel according to claim 1, wherein the abutment web (4), in a portion remote from the flange, has oblong perforations (16) with connecting bolts (17) inserted therethrough, said bolts having at least one projection (18) which juts out radially from an end of the bolt, said bolts being rotatable into a locking position whereby in the locking position said projection engages behind an edge of a perforation (16).

10. A form panel according to claim 9, wherein said oblong perforations have a keyhole shape.

11. A form panel according to claim 9, wherein the form panel is adapted for connection to neighboring form panels having flat edging strips, having perforations of a determined size and spacing, and wherein the oblong perforations (16) in the abutment web (4) have a size and spacing which correspond with the size and spacing of the perforations in the flat edging strips of the neighboring form panels.

12. A form panel according to claim 11, wherein the flat edging strips have a thickness and the abutment web has a thickness and wherein said bolts (17) have a counter-stop (21) axially spaced from said projection (18) and the clearance between the radially jutting out projection (18) and the axially spaced counter-stop (21) corresponds to an overall thickness of the flat edging strip of a neighboring form panel plus the abutment web (4).

13. A form panel according to claim 12, wherein the counter-stop (21) comprises a disk spring.

14. A form panel according to claim 9, wherein the perforations (16) in the abutment web (4) are arranged in proximity to the lining skin and second limb (8) that in the locking position the projection (18) jutting out radially from the connecting bolt (17) extends to the second limb (8).

15. A form panel according to claim 14, wherein the second limb (8) has a recess (22) near the perforations (16) in the abutment web (4), whereby in the locking position the projection (18) engages said recess (22).

16. A form panel according to claim 15, wherein the recesses (22) for projections (18) of connecting bolts (17) and the tapped holes (11) are staggered along a vertical length of the abutment web (4).

* * * * *